United States Patent [19]

Frederick

[11] 4,193,589

[45] Mar. 18, 1980

[54] TURNTABLE FOR CLOTH SPREADING MACHINE

[75] Inventor: Cecil S. Frederick, Nashville, Tenn.

[73] Assignee: Cutters Exchange, Inc., Nashville, Tenn.

[21] Appl. No.: 930,178

[22] Filed: Aug. 2, 1978

[51] Int. Cl.[2] ..... B65H 29/46

[52] U.S. Cl. ..... 270/31

[58] Field of Search ..... 270/30–31; 83/488–490, 508

[56] References Cited

U.S. PATENT DOCUMENTS

| | | | |
|---|---|---|---|
| 137,518 | 4/1873 | Warth | 270/31 |
| 2,478,840 | 8/1949 | Sayles | 270/31 |
| 3,173,678 | 3/1965 | McDowell | 270/31 |

*Primary Examiner*—E. H. Eickholt
*Assistant Examiner*—A. Heinz
*Attorney, Agent, or Firm*—Harrington A. Lackey

[57] ABSTRACT

A turntable for supporting a cloth spreading machine adapted to abut the end of a conventional cutting table having an elongated track on each side. The rotary platform of the turntable includes a straight track adapted to align with one track of the cutting table, in one rotary transfer position of the turntable, to permit a cloth spreading machine to be transferred from the cutting table to the turntable. When the turntable is rotated 180°, the platform track is aligned with the other track of the cutting table to permit the cloth spreading machine to be transferred back to the cutting table with the cloth spreading machine reversed end-for-end.

3 Claims, 7 Drawing Figures

TURNTABLE FOR CLOTH SPREADING MACHINE

BACKGROUND OF THE INVENTION

This invention relates to a cloth spreading machine, and more particularly to a turntable for a cloth spreading machine.

Conventionally, a cloth spreading machine supporting a roll or other supply of cloth is adapted to travel longitudinally in reverse reciprocal directions along the length of a cutting table. The cutting table may have a track along one edge or a track along both edges, either of which is adapted to support the track wheels of a cloth spreading machine located along one side of the machine. The remaining non-track wheels merely roll over the surface of the cutting table.

A two-way cloth spreading machine is adapted to lay the cloth in both longitudinal directions along the cutting table. As the direction of spreading is changed, the ends of the cloth are folded. The spreading continues until the desired number of layers of cloth have been accumulated.

In a one-way machine, the cloth spreading machine stops after one layer of cloth has been spread, while the end of the cloth is cut. The machine then dead-heads in the reverse direction, without spreading cloth, to its initial position for spreading a second layer of cloth in the same direction as the first layer. The cycle is repeated.

In a turntable cloth spreading machine, the cloth is spread in one direction, the machine stops, the cloth is cut, the turntable supporting the cloth supply is rotated, and then the cloth is spread in the opposite direction. The machine is again stopped, the cloth is cut and the turntable rotates to its original position, to resume the cycle.

Where it is desired to spread layers of cloth of directional napped material, such as corduroy, in pairs with their napped surfaces face-to-face, and extending in the same direction, none of the above machines or methods of spreading are adequate, unless the cloth roll is turned 180° about a vertical axis at each end of the traverse, or unless the machine is turned around 180°.

SUMMARY OF THE INVENTION

It is therefore an object of this invention to provide a transfer mechanism, and specifically a turntable, for location at one end of a cutting table, to permit the rotation of the cloth spreading machine about a vertical axis, so that directional napped material, such as corduroy, can be spread face-to-face with the nap of opposed layers running in the same longitudinal direction.

The turntable, made in accordance with this invention, includes a support frame, preferably having a fixed platform at one end thereof for securing to one end of a cutting table having a longitudinal track along each longitudinal side of the cutting table. The fixed platform has a pair of short end tracks on opposite sides thereof for alignment with the cutting table tracks. The fixed platform is further provided with a circular segment recess for receiving either of the circular end segments of a rotary platform mounted upon the frame for rotary movement about a vertical axis in alignment with the longitudinal axis of the cutting table, that is, the longitudinal axis extending longitudinally mid-way between the cutting table tracks. The rotary platform is provided along one side thereof with a straight platform track.

One end of the platform track is adapted to abut one of the end tracks on the fixed platform in one rotary transfer position, and the opposite end of the platform track is adapted to abut the other end track of the fixed platform, when the rotary table has been rotated to 180° to its other operative transfer position.

The turntable is also preferably provided with a means for latching the rotary platform in each of its operative transfer positions, and also is preferably provided with latching means for latching the cloth spreading machine upon the rotary turntable during its rotary movement.

DESCRIPTION OF THE PREFERRED EMBODIMENT

Figure 1:
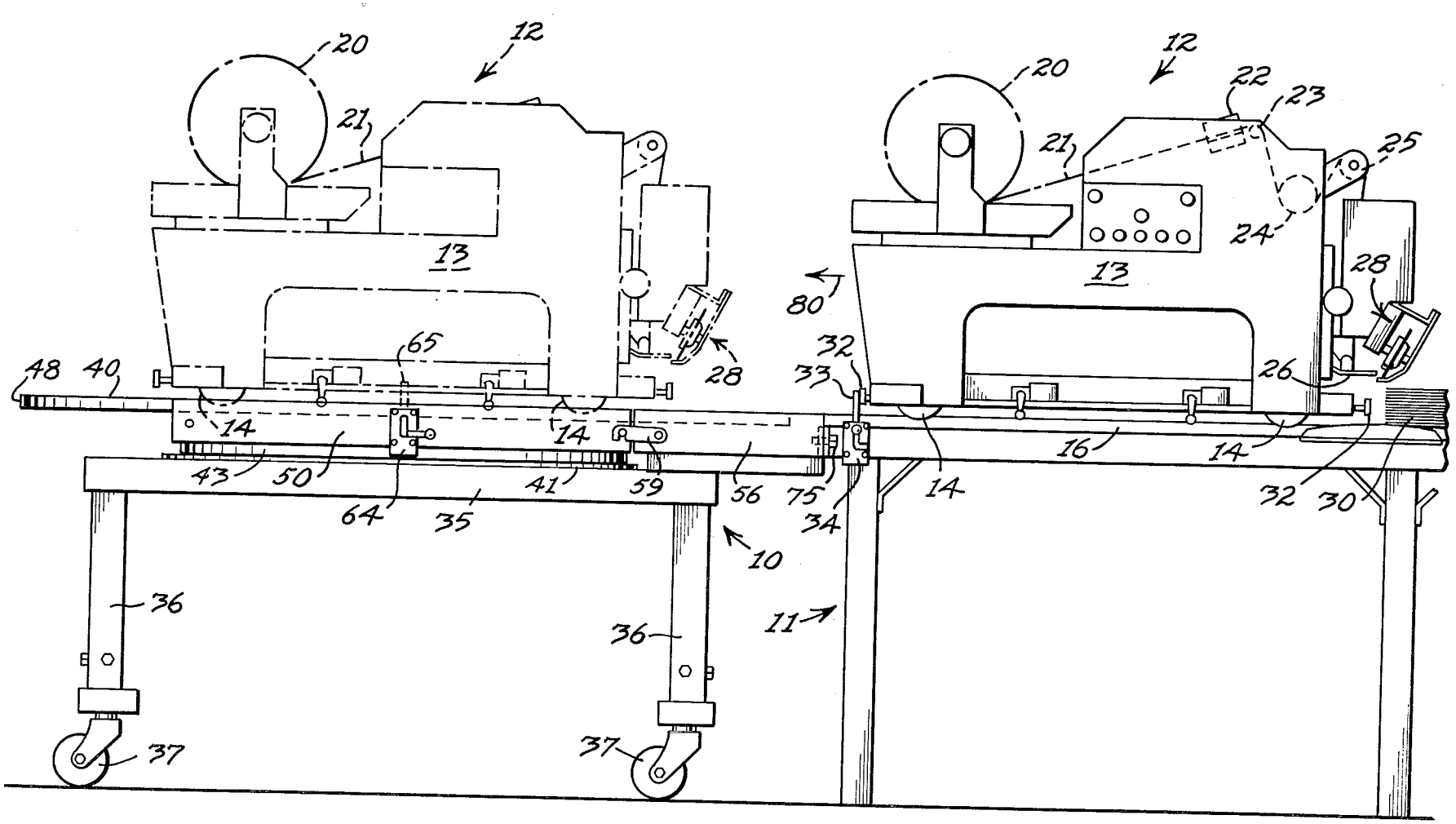
FIG. 1 is a side elevation of a turntable made in accordance with this invention, secured against one end of a cutting table shown fragmentarily. A cloth spreading machine is disclosed in solid lines upon the cutting table and is shown in phantom mounted upon the turntable.
Figure 4:
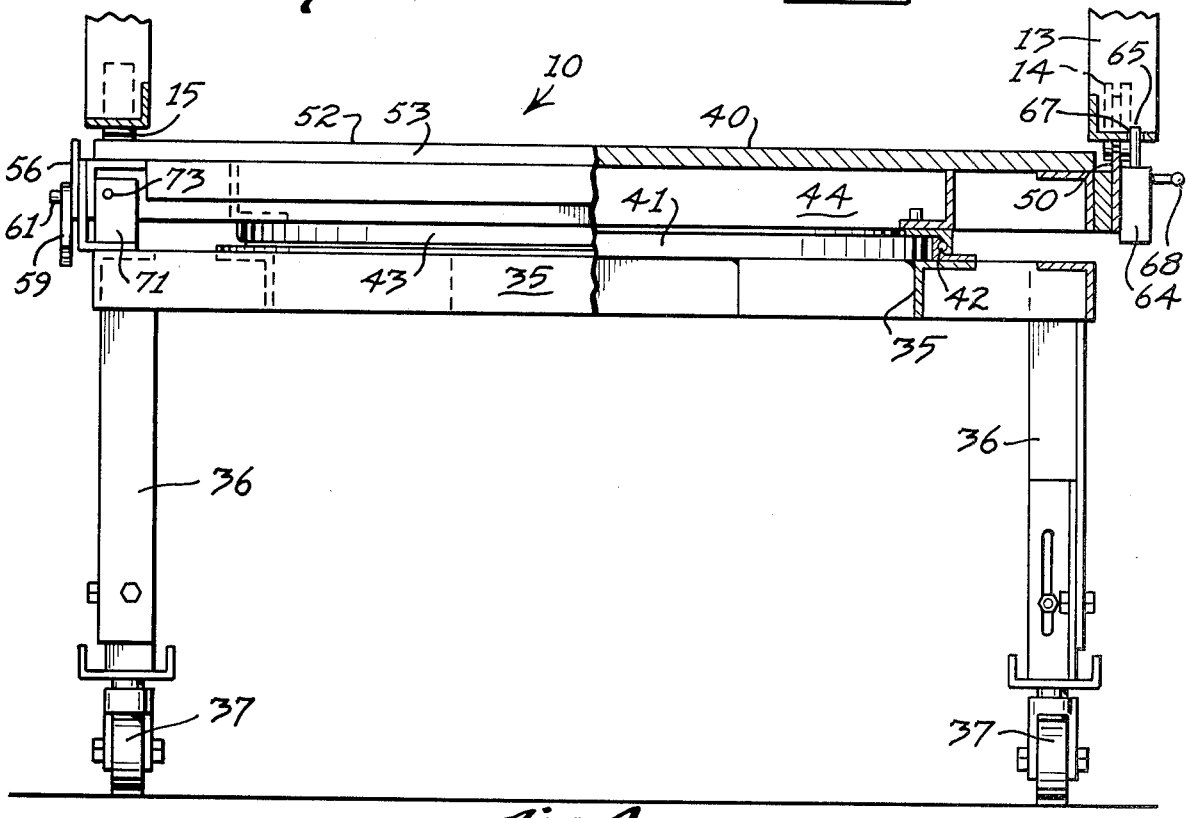
FIG. 4 is an enlarged fragmentary section taken along the line 4—4 of FIG. 3.

Referring now to the drawings in more detail, FIG. 1 discloses a turntable 10, made in accordance with this invention, fixed to the end of a conventional cutting table 11 upon which is supported for longitudinal reciprocal movement a cloth spreading machine 12. The cloth spreading machine 12 includes a mobile frame 13 supported by a pair of grooved or tracked wheels 14 on one side of the machine 12. The opposite, or remote, side of the frame 13 is supported by a pair of smooth, non-track wheels 15 (FIG. 4).

The track wheels 14 are adapted to be supported upon a track or rail 16 mounted along one side edge of the cutting table 11.

Amother longitudinal track or rail 17 is located on the opposite side of the cutting table 11 for supporting the track wheels 14 of the cloth spreading machine 12, when the machine 12 is turned end-for-end.

The elongated cutting table tracks 16 and 17 are mounted parallel to each other and equidistantly on opposite sides of the longitudinal center line 18 of the cutting table 11.

Supported upon the mobile frame 13 is a cloth supply roll 20 from which is fed a cloth web 21. The web 21 is guided through an edge sensor 22, and around guide rollers 23, 24 and 25 to the spreader device 26. Mounted adjacent to the spreader device 26 is a cutter head 28 for transversely cutting the cloth web 21 to form the spread layers 30 upon the cutting table 11.

Each end of the frame 13 is provided with a spring-biased plunger 32 for engagement with a vertically retractible stop member 33 supported for vertical movement in a stop bracket 34.

The turntable 10, made in accordance with this invention, includes a frame 35 from each corner of which depends a leg 36 upon the bottom of which is mounted a caster 37.

A rotary platform 40 is mounted upon the turntable frame 35 by any convenient type of rotary bearing to support the rotary platform for rotary movement about a vertical axis. The particular rotary bearing is disclosed in the form of a stationary ring or circular race 41 mounted upon the frame 35 supporting a plurality of circumferentially spaced spherical or ball bearings 42 carrying a rotary bearing or ring 43 fixed to the bottom of the rotary platform 40. The rotary ring 43 is fixed to a platform frame 44, which in turn supports the rotary platform 40 having a horizontal planar surface.

The rotary platform 40 is preferably elongated, having a pair of parallel side edges 45 and 46 and a pair of circular segment ends 47 and 48 of equal radii and whose circular centers coincide with the rotary vertical axis of the rotary platform 40.

Along the side edge 45 of the rotary platfrom 40 is an elongated straight track or rail 50. The straight track 50 is substantially coextensive with the side edge 45, terminating at the intersection of the ends of the side 45 with the circular segmental ends 47 and 48.

Figure 2:
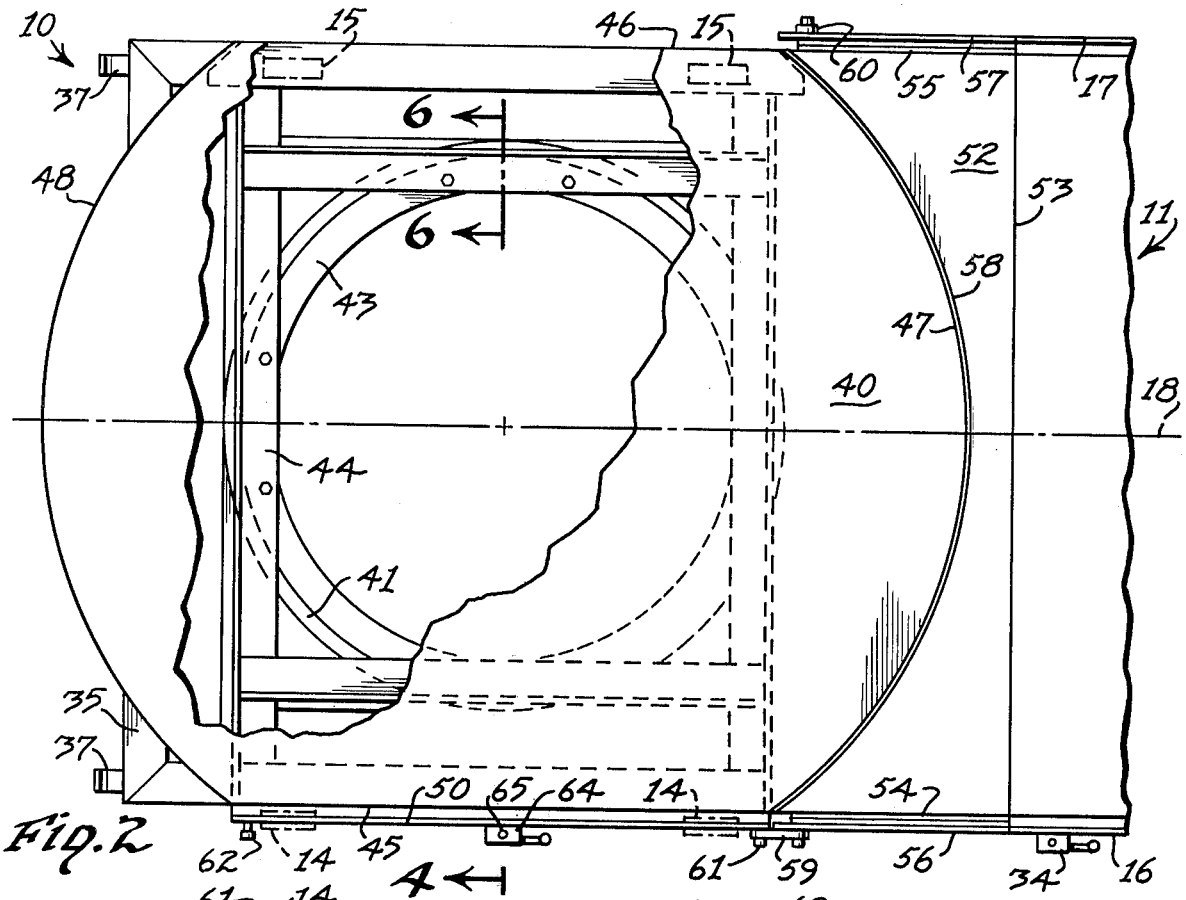
FIG. 2 is a top plan view of the turntable mounted against one end of the cutting table, disclosed fragmentarily, with portions of the rotary platform broken away, and disclosed in the rotary transfer position of FIG. 1.
Figure 3:
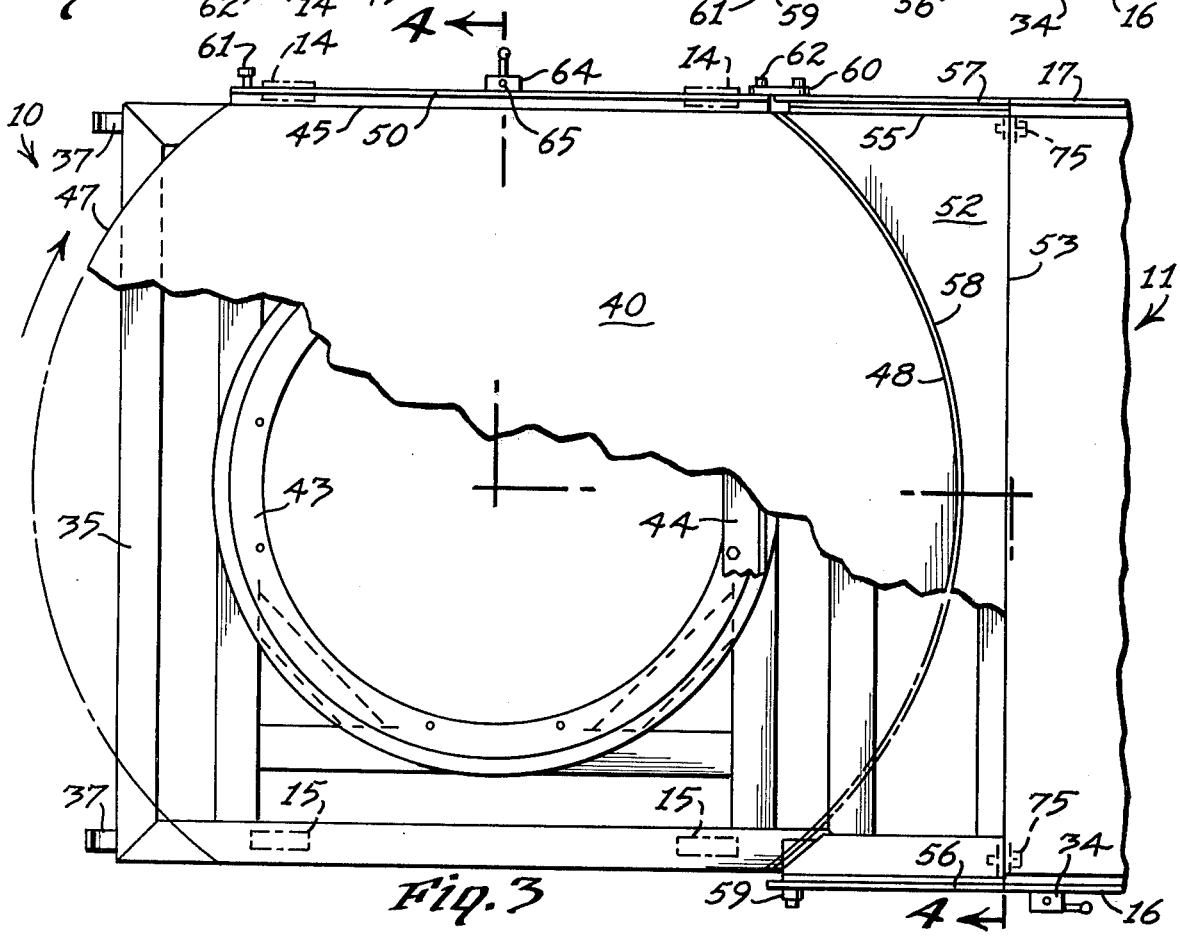
FIG. 3 is a view similar to FIG. 2 with the rotary platform disclosed in its opposite rotary position, and with portions broken away.

Mounted upon one end portion of the turntable frame 35 is a stationary platform 52 having a straight end 53 adapted to abut flush against the straight end of the cutting table 11, as disclosed in FIGS. 2 and 3. The stationary platform 52 has a pair of parallel side edges 54 and 55 which are in alignment with the side edges 45 and 46, when the rotary platform 40 is in either of its operative transfer positions, as disclosed in FIGS. 2 and 3. Mounted coextensively along each side edge 54 and 55 of the stationary platform 52 is an elongated straight end track 56 and 57, respectively. When the rotary platform 40 is in its transfer position disclosed in FIG. 2, the end track 56 is in alignment with, and in substantial abutment with, the platform track 50. When the rotary platform 40 is in its opposite transfer position, as disclosed in FIG. 3, the end track 57 is in alignment with, and in substantial abutment with, the platform track 50.

The stationary platform 52 also includes a circular segmental recess 58 of substantially the same radius as, and complementary with, either of the circular segmental ends 47 and 48 of the platform 40. Thus, when the rotary platform 40 is rotated, to either of its extreme operative transfer positions, as disclosed in FIGS. 2 and 3, the circular segmental recess 58 will receive, in closely adjacent complementary relationship, the corresponding circular segmental end portion 47 or 48, for free rotary movement, but close enough to permit the non-track wheels 15 to roll uninterrupted over the top surfaces of the fixed platform 52 and the rotary platform 40.

Mounted upon each track 56 and 57 adjacent its end opposing the platform track 50 is a pivotal latch hook 59 and 60, respectively. Mounted adjacent each end of the platform track 50 is a latch pin 61 and 62, respectively, for cooperation with the respective latch hooks 59 and 60, respectively. Thus, when the rotary platform 40 is in the operative position disclosed in FIG. 2, the latch hook 59 will engage latch pin 61 to lock the rotary platform 40 in a stationary position relative to the stationary platform 52. On the other hand, when the rotary platform 40 has been rotated 180° to its other operative position, as disclosed in FIG. 3, the latch hook 60 will engage the latch pin 62 in order to lock the rotary platform 40 in a fixed position relative to the stationary platform 52.

Figure 7:
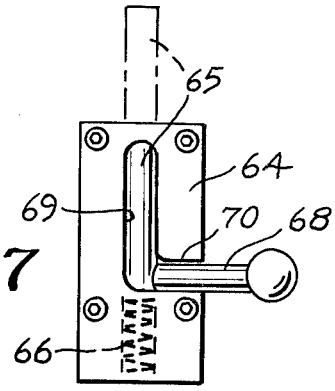
FIG. 7 is an enlarged side elevation of the latch number for securing the cloth spreading machine to the turntable.

In order to lock the spreading machine 12 upon the turntable 10, a latch bracket 64 is fixed to the outboard side of the platform rail 50. Received within the bracket 64 is a vertical latch plunger 65 biased into its upward locking position by a coil spring 66 (FIG. 7). When urged upward to its phantom latched position disclosed in FIG. 7 and in its solid-line position disclosed in FIG. 4, the plunger 65 engages a corresponding aperture 67 in the frame 13 of the spreader machine 12. In order to hold plunger 65 in its unlatched position, a radial arm 68 fixed to the plunger 65 is pulled vertically down in the guide slot 69 until it registers with the lateral slot 70. The radial arm 68 is then pulled laterally in the horizontal guide slot 70 to hold the plunger 65 down against the upward bias of the spring 66, as best disclosed in FIGS. 1 and 7.

As disclosed in FIG. 1, the stop bracket 34 and stop member 33 can have the identical construction as the latch bracket 64 and the latch plunger 65 as disclosed in FIG. 7, if desired.

Figure 5:
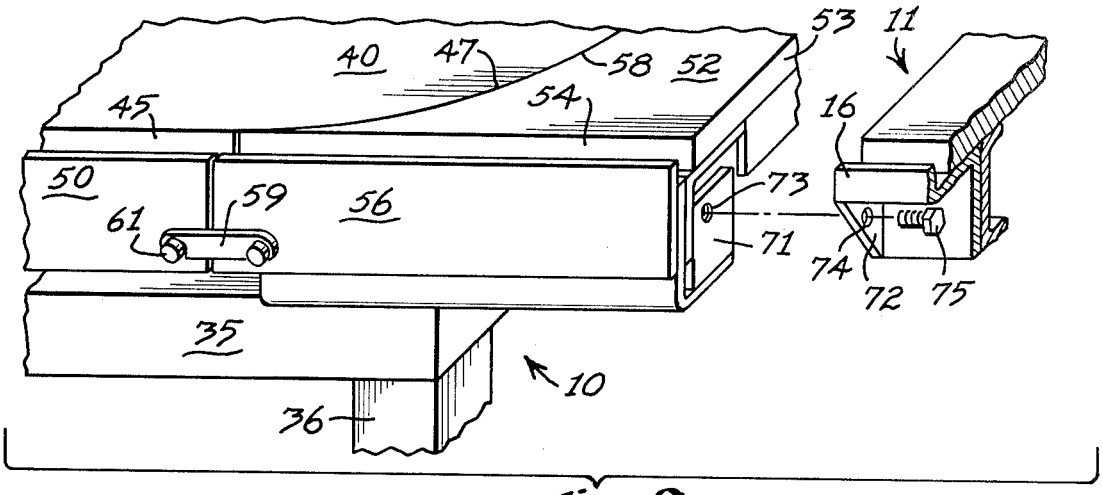
FIG. 5 is an enlarged, fragmentary, exploded, perspective view of one corner end portion of the turntable, and the means for securing the turntable to one end of the cutting table, shown fragmentarily.
Figure 6:
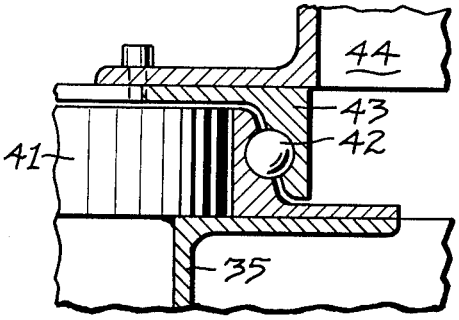
FIG. 6 is an enlarged fragmentary section taken along the line 6—6 of FIG. 2.

As best disclosed in FIGS. 1 and 5, the turntable 10 may be securely fixed to the end of the cutting table 11 by securing means, such as the corresponding abutting plates 71 and 72 having registering holes or apertures 73 and 74 for receiving a threaded bolt 35. The positioning of the plates 71 and 72 is such that the end track 56 will be in alignment with the cutting table track 16, and the opposite end track 57 will be an alignment with the cutting table track table 17, so that the rotary axis of the rotary platform 40 will be in longitudinal alignment with the center line 18.

In the operation of the turntable 10, the end edge 53 of the fixed platform 52 is placed in abutment against the adjacent end of the cutting table 11, and turntable 10 and cutting table 11 are secured in fixed position by the securing bolt 75.

If the spreader machine 12 is mounted upon the cutting table 11 in the manner disclosed in FIG. 1, with the track wheels 14 engaging the proximate track or rail 16, then the rotary platform 40 is manipulated so that the platform track 50 is on the same side of the turntable 10 as, and in alignment with, the track 16, as well as in alignment with the end track 56. The latch hook 59 is then engaged with the latch pin 61 to hold rotary platform 40 in the fixed transfer position disclosed in FIG. 2.

After the cloth spreading machine 12 has spread the first layer of napped cloth, moving in the direction of the arrow 80 (FIG. 1) toward the turntable 10, the machine is stopped, with the plunger 32 engaging the stop member 33. The cloth web is then cut by the transverse movement of the cutter head 28. Stop member 33 is then lowered into its bracket 34 to permit the cloth spreading machine 12 to be moved toward the left of FIG. 1 upon the turntable 10.

When the cloth spreading machine 12 has completely moved off the cutting table 11 and is entirely supported by the rotary platform 40 in the position disclosed in phantom in FIG. 1, the radial arm 68 is released by moving it in the horizontal slot 70 until it is in alignment with the vertical guide slot 61, thereby permitting the spring 66 to urge the plunger 65 up into the corresponding aperture 67 in the machine frame 13, as disclosed in FIGS. 1 and 4. Thus, the cloth spreading machine 12 will be locked in position upon the rotary platform 40.

The latch hook 59 is then raised to disengage the latch pin 61, and the rotary platform 40 is then rotated manually or by appropriate motive means to turn the rotary platform 40 as well as the cloth spreading machine 12 completely thru an arc of 180° about the vertical axis of the rotary platform 40, until the platform 40 assumes its opposite operative transfer position disclosed in FIG. 3. In this position, the platform track 50 is now in alignment with the end track 57, which in turn is in alignment with the remote track 17 on the opposite side of the cutting table 11. The latch hook 60 is then engaged with the latch pin 62 to hold the rotary platform 40 in its new operative transfer position.

The cloth spreading machine 12, now having been turned completely end-for-end, is then pushed or otherwise moved longitudinally from the turntable 10 back upon the cutting table 11. However, this time, the track wheels 14 are now riding upon the remote track 17.

Cloth spreading machine 12 is re-started and run in the opposite direction away from the turntable 10 toward the opposite end of the cutting table 11 but without spreading cloth. In other words, the spreading machine 12 "dead-heads" toward the opposite end of the cutting table 11, but in a reverse attitude. After the cloth spreading machine 12 has reached the opposite end of the cutting table 11, the spreading machine 12 is then re-started to move again toward the left, or in the direction of the arrow 80 (FIG. 1) to spread a second layer of cloth. However, the second layer of cloth is laid in such a manner that it is face-to-face with the first layer, so that the nap on the facing surfaces is directed in the same longitudinal direction.

After the spreading machine has laid its second layer of cloth face-to-face with the first layer, it is again stopped at the left end of the cutting table 11, while the second layer of cloth is cut.

The cycle is then repeated. The cloth spreading machine 12 is moved upon the turntable 10, turned, moved back in the opposite direction down the cutting table without spreading, and then reversed to spread the third layer upon the cutting table 11.

The use of the turntable 10 in conjunction with a conventional cutting table 11 having tracks 16 and 17 on opposite sides and a conventional cloth spreading machine 12 has been found to be the best method of spreading layers of directional napped material face-to-face, where it is desired that the facing nap of the pair of layers, such as opposed trouser legs of corduroy material, lies in the same direction when the patterns are cut.

What is claimed is:

1. A turntable adapted to abut the end of a cutting table having first and second longitudinal tracks spaced equidistantly on opposite sides of a longitudinal center line along the cutting table and adapted to support a cloth spreading machine having at least one track wheel adapted to roll along either of the longitudinal tracks, comprising:

(a) a frame having an end portion adapted to abut the end of a cutting table, (b) a rotary platform adapted to support a cloth spreading machine, (c) bearing means supporting said rotary platform upon said frame for rotation about a vertical rotary axis, (d) said frame end portion having a first end track and a second end track parallel to each other and adapted to align with the respective first and second longitudinal tracks on the cutting table when said end portion abuts the end of the cutting table and when said rotary axis is in alignment with the longitudinal center line, (e) a straight platform track having opposite ends on said rotary platform and spaced from said rotary axis a distance equal to half the spacing between said first and second end tracks, so that said straight platform track may be aligned end-to-end with said first end track in one rotary transfer position of said rotary position, and may be aligned end-to-end with said second end track in another rotary transfer position of said rotary platform, for the transfer of the cloth spreading machine, having a track wheel, between the cutting table and said rotary platform, when said end portion abuts the end of a cutting table and said rotary axis and the longitudinal axis are aligned, (f) latch means on each of said first and second end tracks and on opposite ends of said platform track for latching one end of said platform track against said first end track in said one transfer position and for latching the opposite end of said platform track against said second end track in the other of said transfer positions.

2. The invention according to claim 1 further comprising machine latch means on said platform track for latching the cloth spreading machine in a stationary position upon said rotary platform.

3. The invention according to claim 1 further comprising means securing the end of the cutting table to said frame end portion, with said rotary axis being in longitudinal alignment with the longitudinal center line.

* * * * *